United States Patent [19]

Kent

[11] Patent Number: 4,702,886

[45] Date of Patent: Oct. 27, 1987

[54] CORROSION RESISTANT NICKEL ALLOYED DUCTILE CAST IRON OF FERRITE STRUCTURE

[75] Inventor: Randy K. Kent, Federal Way, Wash.

[73] Assignee: Romac Industries Inc., Seattle, Wash.

[21] Appl. No.: 916,819

[22] Filed: Oct. 9, 1986

[51] Int. Cl.[4] ..... C22C 37/00; C22C 37/04

[52] U.S. Cl. ..... 420/18; 420/13

[58] Field of Search ..... 420/13, 18

[56] References Cited

U.S. PATENT DOCUMENTS 3,549,430 12/1970 Kies ..... 420/18

4,572,751 2/1986 Oguri ..... 420/18

*Primary Examiner*—Peter D. Rosenberg

*Attorney, Agent, or Firm*—Roy E. Mattern, Jr.

[57] ABSTRACT

For better corrosion resistance, ductile cast iron is alloyed with nickel up through percentages of nickel that maintains the primary ferritic phase. Through this range of nickel additions, commencing at approximately 0.2 percent, and ending at approximately 2.0 percent by weight, better corrosion resistance is obtained, while the ductility is maintained and the strength increases. This ductile cast iron alloy is applicable for use in any industry searching for improved corrosion resistance in ductile cast iron, which is obtainable at a low cost. The ductile cast iron is especially applicable for use in the waterworks industry for underground applications. The remaining composition of this ductile cast iron alloy is the composition of common ductile cast iron, including approximately by weight; 2.5–4.0% carbon, 1.7–4.0% silicon, up to 1.0% manganese, 0.01–0.10% magnesium, up to 0.5% copper, up to 0.1% phosphorus, up to 0.7% chromium, up to 0.01% sulphur, up to 1.0% molybdenum, trace amounts of rare earths and other elements, with the remainder being iron and maintaining a primary ferritic phase and primary graphite structure of spheres, thus producing this low cost corrosion resistant ductile cast iron.

3 Claims, 2 Drawing Figures

THE CORROSION RATE VERSUS THE PERCENTAGE NICKEL IN DUCTILE CAST IRON (POUR #1 – #5).

THE ULTIMATE TENSILE STRENGTH AND YIELD STRENGTH VERSUS THE PERCENTAGE OF NICKEL IN DUCTILE CAST IRON (POUR #1–#5).

CORROSION RESISTANT NICKEL ALLOYED DUCTILE CAST IRON OF FERRITE STRUCTURE

BACKGROUND OF THE INVENTION

Since the invention of ductile cast iron by Morrogh, et al., as disclosed in U.S. Pat. No. 2,841,488, many studies have been performed on the effects nickel has on ductile cast iron. Most of these studies use amounts of nickel in a range of percent by weight, that causes the iron phase to change from ferrite to bainite or austenite. It was found that by using nickel as an alloying element in ductile cast iron, several properties are improved, including corrosion resistance. In the past, although nickel has been known to improve the corrosion resistance of many materials, it was not thought of as being effective in ductile iron containing a ferritic phase.

In general with respect to ductile cast iron, ferrite is the major phase in an as-cast condition. However sometimes a self anneal in the mold or a post annealing process is necessary to attain the ferritic phase. The composition of ductile cast iron is similar to gray cast iron with the main difference being in the graphite structure. Ductile iron requires a nodularizing agent, such as magnesium or cerium, to produce a spheroidal graphite structure instead of a flake type of structure formed in gray iron. Because the graphite structure is not continuous and is forming a configuration which produces the least amount of graphite surface area, the ductility is increased extensively in the material.

However, ductile cast iron corrodes, and it has been found that ductile cast iron corrodes, in a manner, where micro galvanic cells are formed between the ferrite matrix and the graphite nodule. Because this galvanic action is dissolving the ferrite matrix, the graphite nodule becomes disconnected from the ferrite. Whether or not the nodule is pulled away from the surface or recombines with ferrite around it, a pit is formed. Once the pit is formed, an autocatalytic system is created and a larger pit appears. This situation can occur in most environments and especially in underground systems. The autocatalytic system is formed, because of the formation of an oxygen cell between the surrounding surface and the base of the pit. At the base of the pit, an acid is formed because of the high concentration of hydrogen ions. If salts are contained in an environment, such as those used for salting roads or that which is found in the ocean, then during this pitting process, hydrochloric acid is formed at the base of the pit.

SUMMARY OF THE INVENTION

Understanding the mode of corrosion set forth in the background of this invention is helpful in understanding this invention. Since the ferrite phase of the ductile cast iron dissolves during the corrosion process and is therefore a corrosiion rate determining parameter, changes made to the ferrite will influence the corrosion rate. This corrosion environment was simulated using mild solutions of hydrochloric acid and nickel was used as an alloying element with the ductile cast iron. The nickel became an integral part of the ferrite matrix, as a substitutional atom, which consequently increased the corrosion resistance of the ductile cast iron.

Thereafter, via the corrosion testing of nickel alloyed ductile cast iron, which remains in the primary phase of ferrite, as the nickel is added up to approximately two percent by weight, it is realized that the corrosion rate decreases as the nickel content increases. Comparative corrosion rates and corrosion electrical potential measurements of the alloyed and unalloyed ductile cast iron, determined by performing potentiodynamic anodic polarization experiments in 1M hydrochloric acid, also indicate that although the corrosion electrical potential increased slightly as the nickel content was increased, it did not increase nearly as fast as the corrosion rate decreased.

While obtaining corrosion resistance, tensile tests, performed on the previously corrosion tested alloys, insured there was no loss of physical prperties of the ductile cast iron, when alloyed with nickel. The yield strength and ultimate tensile strength increased as the nickel content increased and the ductility remained fairly consistent.

A preferred method of making this corrosion resistant nickel alloyed ductile cast iron involves the steps of adding solid nickel alloy to cover solid magnesium alloy, which has been previously placed in a processing ladle, and thereafter pouring in the molten iron. By following these steps, not only is better corrosion resistant alloy obtained, but also the solid magnesium alloy is more efficiently utilized.

DESCRIPTION OF THE PREFERRED EMBODIMENTS

Figure 1:
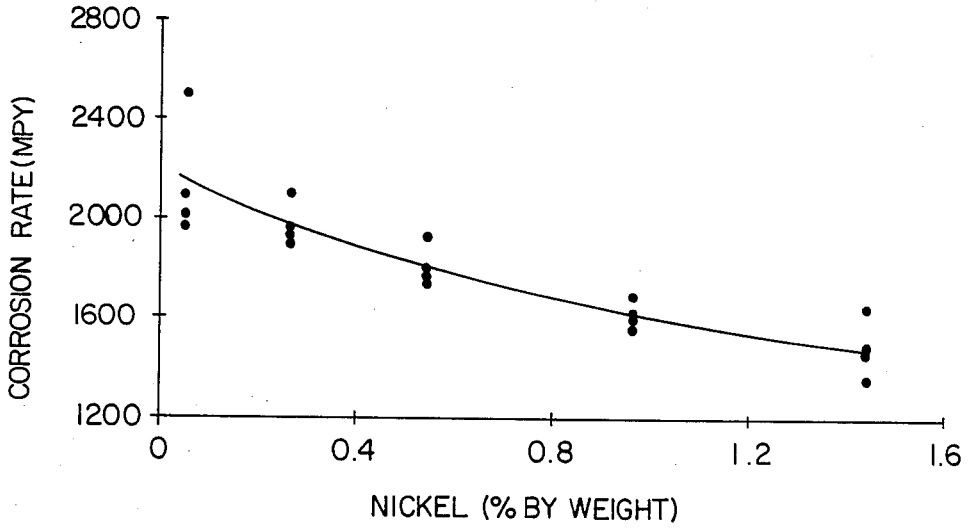
FIG. 1 is a graphical representation of the corrosion rate trend, as the nickel content is increased in ductile cast iron with a ferritic primary phase.

A corrosion resistant ductile cast iron, which remains in the primary ferritic phase, is obtained to meet specified increases in corrosion resistance whie also gaining in strength, by alloying the ductile cast iron, as obtained by following the disclosure of U.S. Pat. No. 2,841,488, which is incorporated herein and adding nickel at a selected time during this process set forth by Morrogh et al. Addition of nickel during the melting process of ductile cast iron is not limited to a specific time within the sequence of normal additions prior to the pouring process. However, when selecting a time to add the nickel, it is important to choose the most beneficial sequence of steps to improve the efficiency of all additives in the overall process. It has been knwon that magnesium dispersion and magnesium loss to the atmosphere are normally difficult to control, even though Morrogh et al. and others have stated that the dispersion of the magnesium or cerium is improved when alloyed with nickel.

By following the preferred steps of this making of the corrosion resistant nickel alloyed ductile cast iron, the way in which nickel is added improves the retention of the magnesium. The preferred steps involve the addition of a nickel alloy as a cover for the magnesium alloy. In the step of pouring the molten iron over the nickel covered magnesium alloy, the floating of the magnesium is thereby reduced and retention is much improved, thereby improving the efficiency of the use of magnesium alloy.

Since the amounts of nickel added to the ductile iron to improve the corrosion resistance is limited by the fact that the ferritic primary phase must be maintained and not change to bainite, then each foundry must determine the most beneficial nickel content for their situation. The point at which this unwanted transformation of ferrite to bainite might occur is dependent on several parameters. These parameters vary from foundry to foundry and therefore an analysis of the ductile iron when adding nickel must be performed in each situation. When setting up limits for the nickel content, i.e., when the transformation from ferrite to bainite might occur, the range of nickel used to find the transformation should be between approximately 1.6 and 2.4 percent by weight.

In the following Table 1, data is presented in respect to five pours. Pour 1 is the essentially unalloyed ductile cast iron serving as the control pour. Pours 2 through 5 have progressing increasing nickel content. Other elements stayed about the same. This table presents results of electrochemical experiments, in reference to both improved corrosion rates and corrosion potential. This table also presents the improved physical properties.

TABLE 1

Examples of nickel alloyed and unalloyed ductile cast iron corrosion properties and physical properties.

| | Pour Number | | | | |
|---|---|---|---|---|---|
| | 1 (control) | 2 | 3 | 4 | 5 |
| Content (wt. %) | | | | | |
| Ni | 0.05 | 0.26 | 0.54 | 0.96 | 1.44 |
| C | 3.36 | 3.39 | 3.47 | 3.44 | 3.35 |
| Si | 2.48 | 2.59 | 2.58 | 2.57 | 2.64 |
| Mo | 0.11 | 0.11 | 0.11 | 0.11 | 0.11 |
| Cr | 0.06 | 0.07 | 0.06 | 0.06 | 0.07 |
| Mn | 0.05 | 0.05 | 0.05 | 0.05 | 0.05 |
| Cu | 0.03 | 0.04 | 0.04 | 0.04 | 0.04 |
| Ti | 0.03 | 0.03 | 0.03 | 0.03 | 0.03 |
| V | 0.03 | 0.03 | 0.03 | 0.03 | 0.03 |
| Al | 0.02 | 0.02 | 0.02 | 0.02 | 0.02 |
| P | 0.01 | 0.01 | 0.01 | 0.01 | 0.02 |
| S | 0.01 | 0.01 | 0.01 | 0.01 | 0.01 |
| Corrosion Rate (mpy, 1M HCL soln): | | | | | |
| Run #1 | 1972 | 1967 | 1926 | 1607 | 1495 |
| Run #2 | 2018 | 1896 | 1774 | 1587 | 1348 |
| Run #3 | 2093 | 2099 | 1739 | 1683 | 1364 |
| Run #4 | 2504 | 1931 | 1769 | 1541 | 1642 |
| Average | 2146 | 1973 | 1802 | 1605 | 1462 |
| Corrosion Potential (Ecorr, Millivolts) | | | | | |
| (Average of 4 tests) | 473.8 | 476.5 | 455 | 460 | 445.8 |
| Physical Properties: | | | | | |
| Tensile Strength (ksi) | 61.5 | 64 | 64.5 | 66.5 | 68 |
| Yield Strength (ksi) | 43 | 44.5 | 46.5 | 47.5 | 51 |
| % Elongation | 23.5 | 23 | 23.5 | 22 | 20.5 |

In the drawing, FIG. 1, in respect to pour examples 1 through 5, indicates graphically how the corrosion rate decreases, as the percentage of nickel is increased in this nickel alloyed ductile cast iron, that maintains the primary ferritic phase. Also in the drawing, FIG. 2, in respect to these pour examples 1 through 5, indicates graphically how the strength increases, as the percentage of nickel is increased in this nickel alloyed ductile cast iron, that maintains the primary ferritic phase.

Figure 2:
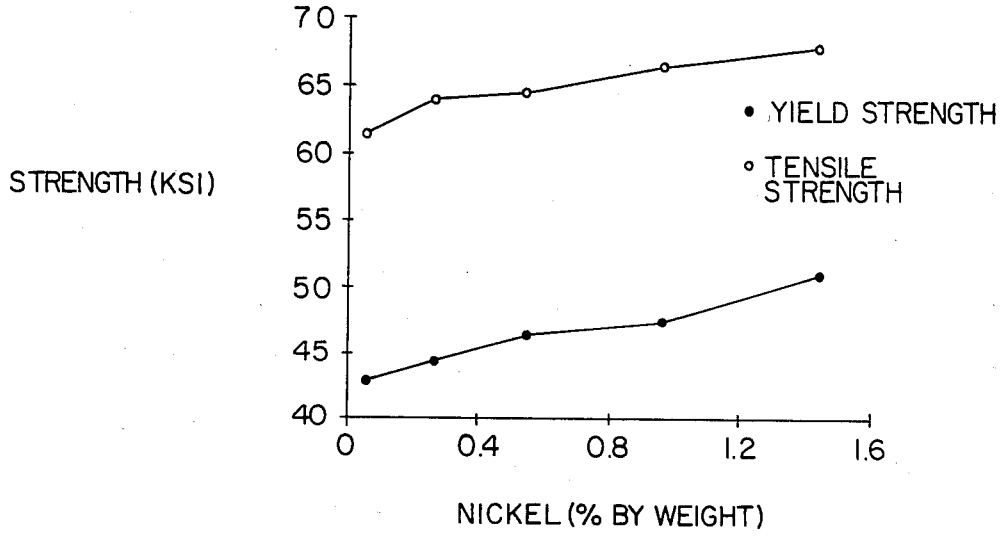
FIG. 2 is a graphical representation of the ultimate tensile strength and yield strength as the nickel content is increased in the ductile cast iron with a ferritic primary phase.

Although the cost of the nickel adds to the overall cost of this better corrosion resistant iron, these excellent benefits illustrated and described in FIGS. 1 and 2, especially in reference to decreasing the corrosion rate, are obtained at a very comparatively lower initial cost. Subsequently, because of the longer active life of the products, so made with this corrosion resistant alloyed ductile cast iron, there is an overall substantial saving realized during a longer time period of observation and consideration.

I claim:

1. A corrosion resistant nickel alloyed ductile cast iron that maintains the primary ferritic phase, wherein nickel is added in selected amounts, within a range from 0.2 to 2.0% by weight, having improved corrosion resistance, as determined through electrochemical tests, and the remaining composition being of common ductile cast iron, including approximately by weight; 2.5–4.0% carbon, 1.7–4.0% silicon, up to 1.0% manganese, 0.01–0.10% magnesium, up to 0.5% copper, up to 0.1% phosphorus, up to 0.7% chromium, up to 0.01% sulphur, up to 1.0% molybdenum, trace amounts of rare earths and other elements, with the remainder being iron the primary ferritic phase, having primary graphite structure of spheres, thus producing a low cost corrosion resistant ductile cast iron.

2. A low cost corrosion resistant nickel alloyed ductile cast iron in the primary ferritic phase having nickel in the range of percentage by weight commencing just above zero and ending approximately at two, with the maximum amount being governed by maintaining the primary ferritic phase, and the remaining composition being of commonly designated ductile cast iron with the elements being in their respective ranges of percentage by weight of: 2.5 to 4.0 carbon; 1.7 to 4.0 silicon; up to 1.0 manganese; 0.01 to 0.10 magnesium; up to 0.5 copper; up to 0.1 phosphorus; up to 0.7 chromium; up to 0.01 sulphur; up to 1.0 molybdenum; trace amounts of rare earths and other elements; and the remainder being iron of the primary ferritic phase having graphite structure of spheres.

3. A low cost corrosion resistant nickel alloyed ductile cast iron in the primary ferritic phase having nickel in the range of percentage by weight from 0.1 to approximately 2.0, with the maximum amount being governed by maintaining the primary ferritic phase, and the remaining composition being of commonly designated ductile cast iron with the elements being in their respective ranges of percentage by weight of: 2.5 to 4.0 carbon; 1.7 to 4.0 silicon; up to 1.0 manganese; 0.01 to 0.10 magnesium; up to 0.5 copper; up to 0.1 phosphorus; up to 0.7 chromium; up to 0.01 sulphur; up to 1.0 molybdenum; trace amounts of rare earths and other elements; and the remainder being iron of the primary ferritic phase.

* * * * *